US010294800B2

(12) United States Patent
Facchinetti et al.

(10) Patent No.: US 10,294,800 B2
(45) Date of Patent: May 21, 2019

(54) GAS TURBINE BLADE

(71) Applicant: ANSALDO ENERGIA SWITZERLAND AG, Baden (CH)

(72) Inventors: Emanuele Facchinetti, Zurich (CH); Guillaume Wagner, Lausanne (CH); Marc Henze, Wettingen (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 354 days.

(21) Appl. No.: 15/200,428

(22) Filed: Jul. 1, 2016

(65) Prior Publication Data

US 2017/0002665 A1 Jan. 5, 2017

(30) Foreign Application Priority Data

Jul. 2, 2015 (EP) ..... 15175035

(51) Int. Cl.
*F01D 5/18* (2006.01)
*F01D 9/04* (2006.01)
(Continued)

(52) U.S. Cl.
CPC ..... *F01D 5/187* (2013.01); *F01D 5/188* (2013.01); *F01D 9/041* (2013.01); *F01D 9/065* (2013.01);
(Continued)

(58) Field of Classification Search
CPC ..... F01D 9/065; F01D 5/186; F01D 5/187; F01D 5/188; F01D 5/189; F05D 2260/20;
(Continued)

(56) References Cited

U.S. PATENT DOCUMENTS 5,145,315 A * 9/1992 North ..... F01D 5/189 29/889.722
5,609,466 A * 3/1997 North ..... F01D 5/187 415/115
(Continued)

FOREIGN PATENT DOCUMENTS

EP 1 146 202 A2 10/2001
EP 1 160 418 A2 12/2001
(Continued)

OTHER PUBLICATIONS

European Search Report dated Jan. 19, 2016, issued by the European Patent Office in the corresponding European Patent Application No. 15175035.3-1610. (7 pages).

*Primary Examiner* — Christopher Verdier
(74) *Attorney, Agent, or Firm* — Buchanan Ingersoll & Rooney PC

(57) ABSTRACT

A gas turbine blade includes a blade root and a blade aerofoil, a cooling fluid plenum extending inside the gas turbine blade through the blade root, the blade aerofoil and the blade tip, a blade root impingement plate in the cooling fluid plenum inside the blade root and a blade tip impingement plate in the cooling fluid plenum inside the blade tip, the blade tip impingement plate having at least one cooling fluid hole configured and arranged to enable a cooling fluid to flow from the blade tip into the blade aerofoil via the cooling fluid hole or holes, and a pipe extending in the cooling fluid plenum from the blade root impingement plate to the blade tip impingement plate. The blade root impingement plate can direct the cooling fluid from the blade root to the pipe.

11 Claims, 4 Drawing Sheets

(51) Int. Cl.
*F01D 9/06* (2006.01)
*F01D 25/12* (2006.01)

(52) U.S. Cl.
CPC ..... *F01D 25/12* (2013.01); *F05D 2220/32* (2013.01); *F05D 2240/81* (2013.01); *F05D 2260/201* (2013.01)

(58) Field of Classification Search
CPC ..... F05D 2260/201; F05D 2260/202; F05D 2240/81
See application file for complete search history.

(56) References Cited

U.S. PATENT DOCUMENTS 6,065,928 A * 5/2000 Rieck, Jr. ..... F01D 5/189 415/115
6,398,486 B1 6/2002 Storey et al.
7,007,488 B2 * 3/2006 Orlando ..... F01D 9/065 60/782
2002/0028135 A1 3/2002 Burdgick
2010/0310367 A1 * 12/2010 Devore ..... F01D 5/189 416/1
2013/0189110 A1 7/2013 Batt et al.
2013/0315725 A1 * 11/2013 Uechi ..... F01D 5/189 415/208.1
2014/0341723 A1 * 11/2014 Bourassa ..... F01D 9/065 415/175
2017/0234144 A1 * 8/2017 Mugglestone ..... F01D 5/188 415/178

FOREIGN PATENT DOCUMENTS

EP 2 2 56 297 A1 12/2010
EP 2 436 884 A1 4/2012
EP 2626519 A1 * 8/2013 ..... F01D 5/188
GB 1 605 220 A 8/1984

* cited by examiner

GAS TURBINE BLADE

TECHNICAL FIELD

The present disclosure relates to gas turbine blades, and particularly to gas turbine blades comprising a cooling fluid plenum extending inside the gas turbine blade.

BACKGROUND OF THE INVENTION

In various places in gas turbines, temperatures of many hundreds of degrees are encountered, placing severe strain on materials. To withstand these, various solutions have been implemented by gas turbine manufacturers, including the use of materials that can perform at high temperatures and the use of extensive cooling systems in the hottest areas of gas turbines.

Some of the hottest and most hostile environments in gas turbines are found adjacent to the hot gas flow in the compressor and the turbine. As a result, the blades and vanes used in these regions include cooling systems to reduce the blade/vane (rotating blade/stationary blade) temperature.

An example of a vane cooling system can be seen in EP 2256297 of Alstom Technology Ltd. While this provides effective cooling to the vane, it has been appreciated that further improvements can be made.

SUMMARY OF THE INVENTION

According to a first aspect, there is provided a gas turbine blade comprising a blade root and a blade aerofoil, the blade root being attached to a first end of the blade aerofoil, a blade tip attached to a second end of the blade aerofoil, a cooling fluid plenum extending inside the gas turbine blade through the blade root, the blade aerofoil and the blade tip, a blade root impingement plate in the cooling fluid plenum inside the blade root and a blade tip impingement plate in the cooling fluid plenum inside the blade tip, the blade tip impingement plate comprising at least one cooling fluid hole configured and arranged to enable a cooling fluid to flow from the blade tip into the blade aerofoil via the cooling fluid hole or holes, and a pipe extending in the cooling fluid plenum from the blade root impingement plate to the blade tip impingement plate, and the pipe being configured and arranged to transport the cooling fluid from the blade root to the blade tip, and the blade root impingement plate being configured and arranged to direct the cooling fluid from the blade root to the pipe. This can improve cooling scheme efficiency by reducing cooling fluid flow requirements. It can reduce number and/or size of cooling fluid holes in the blade tip. It can also increase backflow margin in the blade tip, which can allow more flexible gas turbine operation. It can also improve part load flexibility.

In one embodiment, the pipe is attached to the blade tip impingement plate and slidably attached to the blade root impingement plate. In another embodiment, the pipe is slidably attached to the blade tip impingement plate and attached to the blade root impingement plate. Providing a slidable attachment can allow relative movement between the parts due to differing thermal expansion. In another embodiment, the pipe is slidably attached by a centre cavity seal. This can provide a seal at the slidable joint to help reduce leakage through the joint.

In one embodiment, at least one cooling fluid hole is provided in the blade root impingement plate. This can help cool the blade root, for example by impingement cooling.

In one embodiment, a trailing edge cooling fluid hole in the blade tip is provided, the trailing edge cooling fluid hole being configured and arranged to direct a portion of the cooling fluid to cool another gas turbine blade downstream of the gas turbine blade in the hot gas flow direction. This can help improve cooling scheme efficiency.

In one embodiment an aerofoil impingement sheet is arranged in the cooling fluid plenum and attached to a wall of the gas turbine blade, the aerofoil impingement sheet comprising impingement cooling fluid holes, the impingement cooling fluid holes being configured and arranged to direct cooling fluid to impinge on the blade aerofoil. This can help cool the blade aerofoil.

In one embodiment, a centre cavity seal is slidably attached to the aerofoil impingement sheet and attached to the wall of the gas turbine blade. This can allow relative movement between the parts due to differing thermal expansion, and can help reduce leakage through the joint. In one embodiment, the gas turbine blade is a gas turbine vane.

A second aspect provides a gas turbine comprising the gas turbine blade described above.

A third aspect provides a method of cooling a gas turbine blade as described above, the method comprising the steps of directing the cooling fluid from the blade root to the blade tip through the pipe, and directing the cooling fluid from the blade tip to the blade aerofoil through the blade tip impingement plate. In one embodiment, the method comprising directing a portion of the cooling fluid through the blade root impingement plate to impinge on the blade root.

BRIEF DESCRIPTION OF THE DRAWINGS

An embodiment of the invention will now be described by way of example only and with reference to the accompanying drawings in which.

DETAILED DESCRIPTION OF THE PREFERRED EMBODIMENTS

Examples of the invention in vanes will now be described. The invention can also be applied to blades in general. A vane is a type of blade, with blades in general including rotating blades on a rotor and stationary blades (vanes) on a stator.

Figure 1:
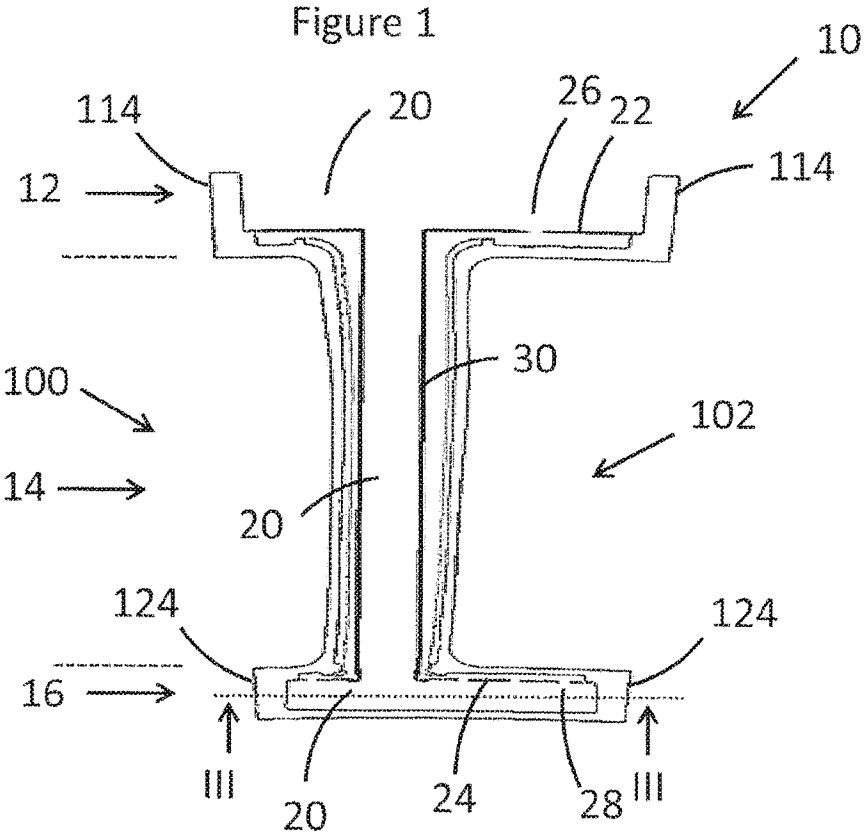
FIG. 1 shows a cross-section of a vane from the suction side to the pressure side according to the invention.
Figure 2:
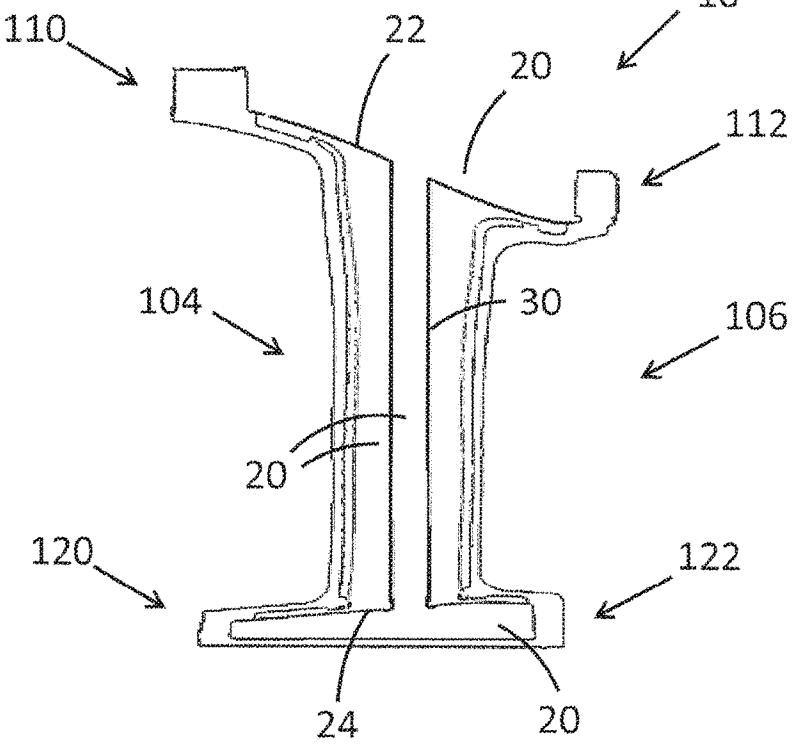
FIG. 2 shows a cross-section of the vane of FIG. 1 from the trailing edge to the leading edge.

As shown in FIGS. 1 and 2, a gas turbine vane 10 comprises a vane root 12 (outer diameter platform), a vane aerofoil 14 and a vane tip 16 (inner diameter platform). The vane root 12 is attached to a first end of the vane aerofoil 14 and the vane tip 16 is attached to a second end of the vane aerofoil 14, distal from the first end. FIG. 1 shows a cross-section from the suction side 100 to the pressure side 102, and FIG. 2 shows a cross-section from the trailing edge 104 to the leading edge 106. When in use, hot gas flows in the direction from the leading edge 104 to the trailing edge 106.

A cooling fluid plenum 20 extends inside the vane 10 through the vane root 12, the vane aerofoil 14 and the vane tip 16. A vane root impingement plate 22 is provided in the cooling fluid plenum 20 inside the vane root 12, and a vane tip impingement plate 24 is provided in the cooling fluid plenum 20 inside the vane tip 16. The vane tip impingement plate 24 comprises a cooling fluid hole or holes 28 configured and arranged to enable a cooling fluid to flow (in the cooling fluid plenum 20) from the vane tip 16 into the vane aerofoil 14 via the cooling fluid hole or holes 28.

A pipe 30 is also provided, the pipe 30 extending in the cooling fluid plenum 20 from the vane root impingement plate 22 to the vane tip impingement plate 24, and the pipe 30 being configured and arranged to transport the cooling fluid from the vane root 12 to the vane tip 16. The vane root impingement plate 22 is configured and arranged to direct the cooling fluid from the vane root 12 to the pipe 30.

Figure 3:
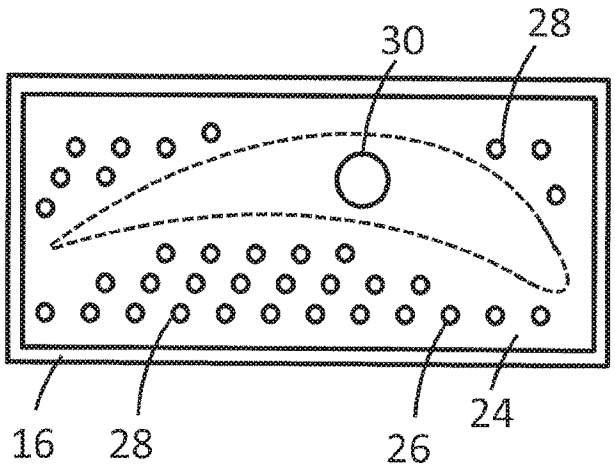
FIG. 3 shows a cross-section along III-Ill in FIG. 1.

FIG. 3 shows a view from the dotted line denoted III-III in FIG. 1, showing a possible configuration of cooling fluid holes 28 in the vane tip impingement plate. The shape of the vane aerofoil has been shown as a dotted line for reference.

Figure 4:
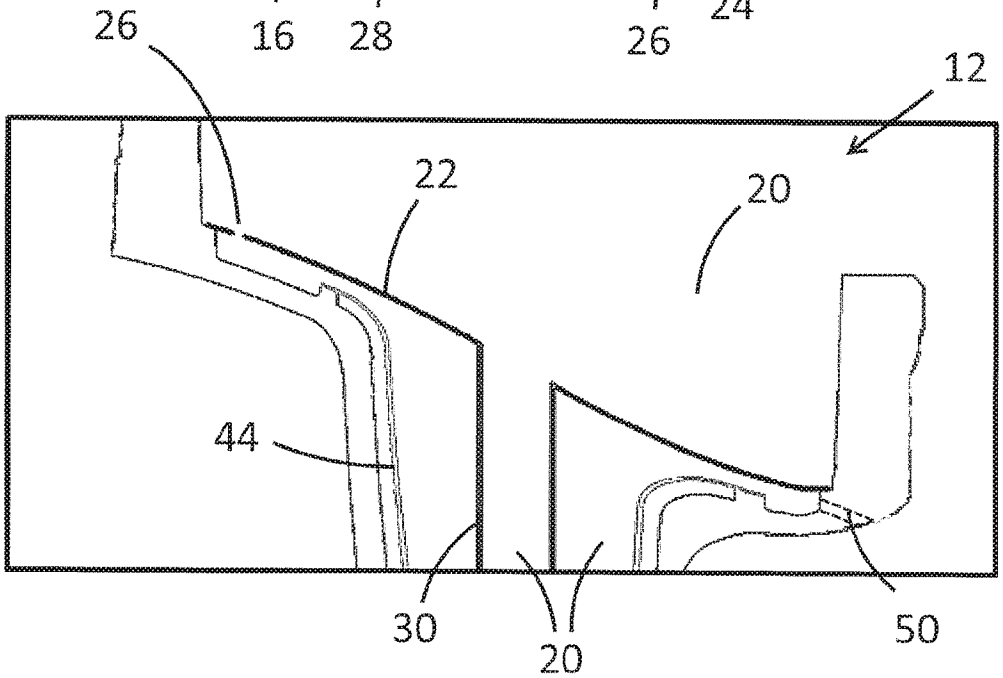
FIG. 4 shows a close-up of the vane root of a vane as shown in FIG. 1.

FIG. 4 shows a close-up of the vane root 12, and FIG. 5 shows a close-up of the vane tip 14, including a trailing edge cooling fluid hole 40 and pins 42. An aerofoil impingement sheet 44 can also be seen.

Figure 5A:
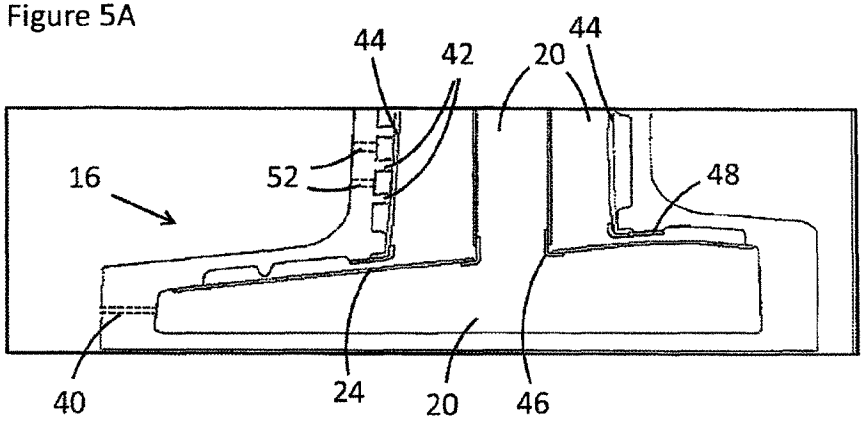
FIGS. 5A and 5B show a close-up of the vane tip of a vane as shown in FIG. 1 and a close-up of the vane root of a vane as shown in FIG. 1, respectively.
Figure 5B:
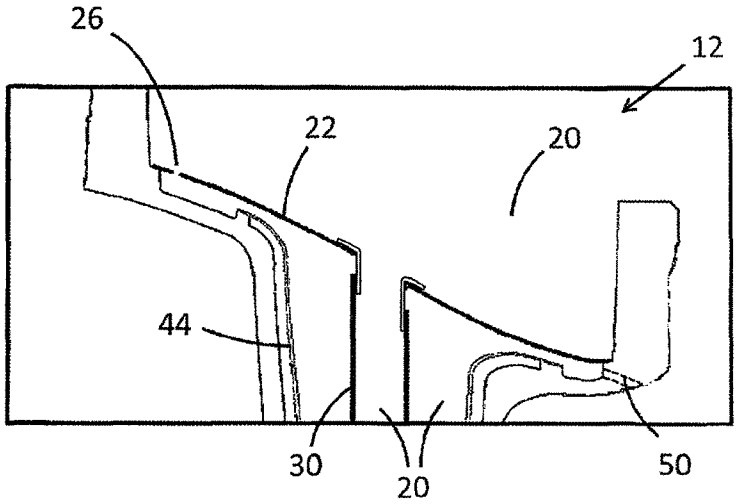

The pipe 30 is preferably attached to one of the vane root impingement plate and the vane tip impingement plate, and is slidably attached to the other. In FIG. 5A, the pipe is shown slidably attached to the vane tip impingement plate. A seal such as a centre cavity seal 46 (a cylindrically shaped seal, with a hole through the middle) can be provided to maintain a seal on the slidable joint between the pipe and the vane tip impingement plate.

In a method of using the vane described above, cooling fluid is directed from the vane root to the vane tip through the pipe, and then the vane tip to the vane aerofoil through cooling fluid holes 28 in the vane tip impingement plate.

A portion of the cooling fluid entering the vane root can pass through the vane root impingement plate to help cool the vane root, and a portion of the cooling fluid entering the vane root can pass through cooling fluid holes in the vane root to help cool the vane root (these vane root cooling fluid holes are described in more detail below).

A portion of the cooling fluid entering the vane tip can pass through cooling fluid holes in the vane tip to help cool the vane tip (these vane tip cooling fluid holes are described in more detail below). Some of this cooling fluid can pass through trailing edge cooling fluid holes 40 (described in more detail below).

Once the cooling fluid is in the vane aerofoil, some or all of the cooling fluid may be used to cool the vane aerofoil by impingement through an aerofoil impingement sheet 44. Additionally or alternatively, the cooling fluid may pass through cooling fluid holes in the vane aerofoil, thereby exiting the cooling fluid plenum.

Gas turbine blades according to the invention would typically be used in the turbine of a gas turbine, where the gas turbine comprises a compressor, a combustor and a turbine, but could also be used in the compressor. For example, gas turbine vanes according to the invention could be used for vane 2 in a turbine, where vane 2 is the second vane in the turbine when looking from the combustor end. The invention could also be used in other turbine vanes, such as vane 1 or vane 3, and in rotating blades such as blade 2, where blade 2 is the second rotating blade in the turbine when looking from the combustor end.

For the avoidance of doubt, dashed lines are provided in FIG. 1 to show the extent of the vane root 12, the vane aerofoil 14 and the vane tip 16.

The vane root 12 has a trailing edge 110 and a leading edge 112, along with two sides 114 (see FIGS. 1 and 2). Similarly, the vane tip 16 has a trailing edge 120 and a leading edge 122, along with two sides 124.

One or more cooling fluid holes could be provided in at least one of the vane root and the vane tip; these cooling fluid holes could help cool the vane root/tip. The vane root may have cooling fluid holes through the leading edge. The vane root may also have cooling fluid holes through one or more of the trailing edge and sides. An example of the location of a vane root cooling fluid hole 50 is shown in FIG. 4. Similarly, the vane tip may have cooling fluid holes through the trailing edge (such as holes 40, discussed in more detail below). The vane tip may also have cooling fluid holes through one or more of the leading edge and sides.

Further cooling parts can be arranged in the vane aerofoil section of the cooling fluid plenum, such as the pins 42 and the aerofoil impingement sheet 44 mentioned above. The impingement sheet comprises impingement cooling fluid holes (not shown). The aerofoil impingement sheet 44 may have a seal such as a centre cavity seal 48 at one end of the vane aerofoil; in this way, the aerofoil impingement sheet 44 is slidably attached at one end of the vane aerofoil (see FIGS. 5A and 5B, for example). The aerofoil impingement sheet 44 may be attached at the other end of the vane aerofoil (see FIG. 4, for example). The aerofoil impingement sheet can be attached to the vane root or to the vane aerofoil near the vane root at one end and the vane tip or to the vane aerofoil near the vane tip at the other end. Generally, the aerofoil impingement sheet is attached to the wall of the gas turbine vane. The cooling fluid in the vane aerofoil normally exits the vane aerofoil through cooling fluid holes in the vane aerofoil. An example of the location of vane aerofoil cooling fluid holes 52 are shown in FIG. 4.

The cooling fluid plenum 20 is effectively a cavity extending through the vane. The vane root, vane aerofoil and vane tip therefore effectively comprise a wall surrounding the cooling fluid plenum, the wall having an inside surface adjacent to the cooling fluid plenum and an outside surface adjacent to the hot gas flow in the turbine.

The vane root impingement plate 22 will normally completely bisect the cooling fluid plenum, only leaving a gap for cooling fluid to enter the pipe. Cooling fluid holes 26 may also be provided in the vane root impingement plate (see FIG. 1). Cooling fluid can then flow from the vane root directly into the vane aerofoil. The cooling fluid passing through the cooling fluid holes 26 can cool part of the vane root by impingement cooling.

Similarly, the vane tip impingement plate 24 will normally completely bisect the cooling fluid plenum, only leaving a gap for cooling fluid to flow through the cooling fluid plenum from the pipe to the vane tip. The vane tip impingement plate also has cooling fluid holes 28, through which the cooling fluid flows. The cooling fluid passing through the cooling fluid holes 28 can cool part of the vane tip by impingement cooling.

The quantity and arrangement of cooling fluid holes 26, 28 in the vane root impingement plate or the vane tip impingement plate may vary in different embodiments.

The pipe 30 may be brazed or welded to the vane root impingement plate and/or the vane tip impingement plate, for example. Similarly, the centre cavity seal 46 may be brazed or welded, for example, to the vane tip impingement plate.

Part of the cooling fluid may exit the vane tip via a trailing edge cooling fluid hole 40. Cooling fluid that exits the vane through a trailing edge cooling fluid hole can then be used to cool other parts of the gas turbine, such as the blade immediately downstream (in the hot gas flow direction) of the vane discussed herein. A scoop could be provided on the blade to aid cooling fluid transfer into the blade, so that some of the cooling fluid from the vane could then be used for cooling in the blade. The shape of the vane tip and of the corresponding blade could also be adjusted to optimise cooling fluid transfer. Provision of a trailing edge cooling fluid hole is optional, and one or more trailing edge cooling fluid holes could be provided.

The shape of the various components in the examples given above is merely exemplary and may vary in specific embodiments of the invention. For example, the pipe is shown as cylindrical with a circular cross-section, but could have a square cross-section and the pipe need not be straight. The cooling fluid holes are shown as circular, but could be square, rectangular, or another regular or irregular shape.

The cooling fluid may be air or any other suitable gas or liquid. For example, the cooling fluid may be compressed air bled off from the compressor and fed to the vane root.

Various modifications to the embodiments described are possible and will occur to those skilled in the art without departing from the invention which is defined by the following claims.

| REFERENCE NUMERALS | |
|---|---|
| 10 | gas turbine vane |
| 12 | vane root |
| 14 | vane aerofoil |
| 16 | vane tip |
| 20 | cooling fluid plenum |
| 22 | vane root impingement plate |
| 24 | vane tip impingement plate |
| 26 | vane root impingement plate cooling fluid hole |
| 28 | vane tip impingement plate cooling fluid hole |
| 30 | pipe |
| 40 | vane tip trailing edge cooling fluid hole |
| 42 | pins |
| 44 | aerofoil impingement sheet |
| 46 | centre cavity seal |
| 48 | impingement sheet centre cavity seal |
| 50 | vane root cooling fluid hole |
| 52 | vane aerofoil cooling fluid hole |
| 100 | suction side |
| 102 | pressure side |
| 104 | trailing edge |
| 106 | leading edge |
| 110 | vane root trailing edge |
| 112 | vane root leading edge |
| 114 | vane root side |
| 120 | vane tip trailing edge |
| 122 | vane tip leading edge |
| 124 | vane tip side |

The invention claimed is:

1. A gas turbine blade comprising:

a blade root and a blade aerofoil, the blade root being attached to a first end of the blade aerofoil;

a blade tip attached to a second end of the blade aerofoil;

a cooling fluid plenum extending inside the gas turbine blade through the blade root, the blade aerofoil and the blade tip;

a blade root impingement plate in the cooling fluid plenum inside the blade root and a blade tip impingement plate in the cooling fluid plenum inside the blade tip, the blade tip impingement plate having at least one cooling fluid hole configured and arranged to enable a cooling fluid to flow from the blade tip into the blade aerofoil via the cooling fluid hole or holes; and a pipe extending in the cooling fluid plenum from the blade root impingement plate to the blade tip impingement plate, and the pipe being configured and arranged to transport the cooling fluid from the blade root to the blade tip, the pipe being open at each end and unperforated between the ends; and the blade root impingement plate being configured and arranged to direct the cooling fluid from the blade root to the pipe.

2. The gas turbine blade of claim 1, wherein the pipe is attached to the blade tip impingement plate and slidably attached to the blade root impingement plate, or wherein the pipe is slidably attached to the blade tip impingement plate and attached to the blade root impingement plate.

3. The gas turbine blade of claim 2, wherein the pipe is slidably attached by a centre cavity seal.

4. The gas turbine blade of claim 1, comprising;

at least one cooling fluid hole in the blade root impingement plate.

5. The gas turbine blade of claim 1, comprising:

a trailing edge cooling fluid hole in the blade tip, the trailing edge cooling fluid hole being configured and arranged to direct a portion of the cooling fluid to cool a second gas turbine blade downstream of the gas turbine blade in the hot gas flow direction.

6. The gas turbine blade of claim 1, comprising:

an aerofoil impingement sheet arranged in the cooling fluid plenum and attached to a wall of the gas turbine blade, the aerofoil impingement sheet comprising impingement cooling fluid holes, the impingement cooling fluid holes being configured and arranged to direct cooling fluid to impinge on the blade aerofoil.

7. The gas turbine blade of claim 6, comprising:

a centre cavity seal slidably attached to the aerofoil impingement sheet and attached to the wall of the gas turbine blade.

8. The gas turbine blade of claim 1, wherein the gas turbine blade is a gas turbine vane.

9. A gas turbine in combination with the gas turbine blade of claim 1.

10. A method of cooling a gas turbine blade, the gas turbine blade having:

a blade root and a blade aerofoil, the blade root being attached to a first end of the blade aerofoil, a blade tip attached to a second end of the blade aerofoil;

a cooling fluid plenum extending inside the gas turbine blade through the blade root, the blade aerofoil and the blade tip;

a blade root impingement plate in the cooling fluid plenum inside the blade root and a blade tip impingement plate in the cooling fluid plenum inside the blade tip, the blade tip impingement plate having at least one cooling fluid hole configured and arranged to enable a cooling fluid to flow from the blade tip into the blade aerofoil via the cooling fluid hole or holes; and a pipe extending in the cooling fluid plenum from the blade root impingement plate to the blade tip impingement plate, and the pipe being configured and arranged to transport the cooling fluid from the blade root to the blade tip, the pipe being open at each end and unperforated between the ends; and the blade root impingement plate being configured and arranged to direct the cooling fluid from the blade root to the pipe, the method comprising:

directing the cooling fluid from the blade root to the blade tip through the pipe; and directing the cooling fluid from the blade tip to the blade aerofoil through the blade tip impingement plate.

11. The method of claim 10, comprising:

directing a portion of the cooling fluid through the blade root impingement plate to impinge on the blade root.

* * * * *